United States Patent [19]

Vockins

[11] Patent Number: 4,850,114

[45] Date of Patent: Jul. 25, 1989

[54] DECKING SPACER

[76] Inventor: David H. Vockins, 2311 Pimmit Dr., Apt. 811, Falls Church, Va. 22043

[21] Appl. No.: 195,758

[22] Filed: May 19, 1988

[51] Int. Cl.[4] ..... G01B 3/30; G01B 3/32

[52] U.S. Cl. ..... 33/526; 33/645; 33/613

[58] Field of Search ..... 33/168 R, 168 B, 526, 33/613, 644, 645, 501; 52/747, 749, DIG. 1, 127.5, 127.6; 81/46, 488

[56] References Cited

U.S. PATENT DOCUMENTS

| | | | |
|---|---|---|---|
| 2,744,334 | 5/1956 | Jondole | 33/613 |
| 2,759,268 | 8/1956 | Cook | 33/168 B |
| 3,010,213 | 11/1961 | Rodtz | 33/526 |
| 3,104,473 | 9/1963 | Rose | 33/613 |
| 4,765,116 | 8/1988 | Shank | 33/168 R |

*Primary Examiner*—William A. Cuchlinski, Jr.
*Assistant Examiner*—Patrick R. Scanlon
*Attorney, Agent, or Firm*—David H. Semmes

[57] ABSTRACT

Carpenter's tool particularly a wedge or spacer for indexing the desired spacing between adjacent planks. The device consists of an angle brace placed on top of the decking and a wedging plate which extends downwardly as an index between the planks for measured spacing prior to nailing the outside plank to a joist or the like.

10 Claims, 2 Drawing Sheets

DECKING SPACER

CROSS-REFERENCES TO RELATED APPLICATIONS

None.

BACKGROUND OF THE INVENTION

1. Field of the Invention

Carpenter's wedges or spacers, particularly a tool used as a spacer between plank decking. The device consists of an angle brace placed on top of the decking, such that a wedging plate extends downwardly between the planks for measured spacing of an outside plank prior to nailing being secured to a joist or the like.

2. Description of the Prior Art

Mallernee: U.S. Pat. No. 1,278,702
Hardin: U.S. Pat. No. 4,420,921
Greer: U.S. Pat. No. 4,493,477
Diamontis: U.S. Pat. No. 4,625,415

SUMMARY OF THE INVENTION

A decking spacer tool which facilitates laying of plank decking by providing appropriate spacing between planks. The tool includes a longitudinally extending brace having a vertical portion adapted for support upon the top of a plank and a top horizontal portion extending laterally away from the vertical portion and over the desired spacing between adjacent planks. A wedge plate is supported adjacent the angle brace and extends vertically downwardly, as an index of the desired spacing between adjacent planks. A removal lever may be pivoted upon a horizontal axis extending through the brace vertical portion in abutment with the top of a board being fitted. As the removal lever is pivoted downwardly against the board, the decking spacer is urged upwardly and out of the space between boards being fitted.

DESCRIPTION OF THE PREFERRED EMBODIMENTS

Figure 1:
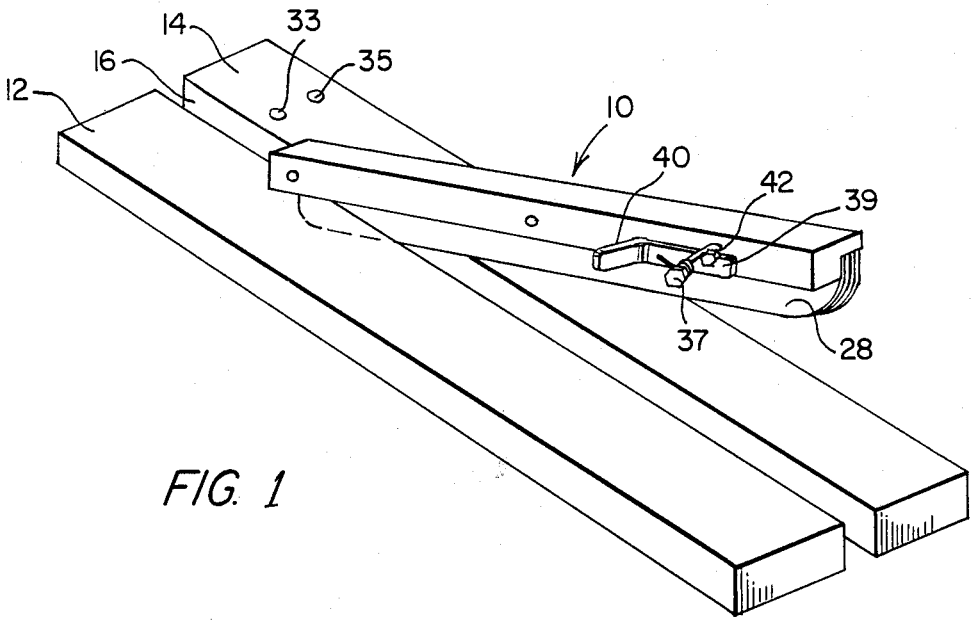
FIG. 1 is a perspective view of the decking spacer tool being fitted between adjacent planks or boards.

In FIG. 1, decking spacer tool 10 is shown in an attitude of insertion as a wedge in the spacing 16 between parallel planks or boards 12 and 14, such that a downwardly extending wedge plate 28 extends into the spacing. As will be apparent, planks 14, 16 may be secured to a supporting joist (not illustrated) by means of conventional nails 35, 33.

Decking spacer tool 10 includes a longitudinally extending angle brace 18 having a vertical portion 19 adapted for support upon the top of a board being fitted and a top portion 20 extending laterally away from the vertical portion and over the desired spacing 16 between the adjacent boards.

Figure 2:
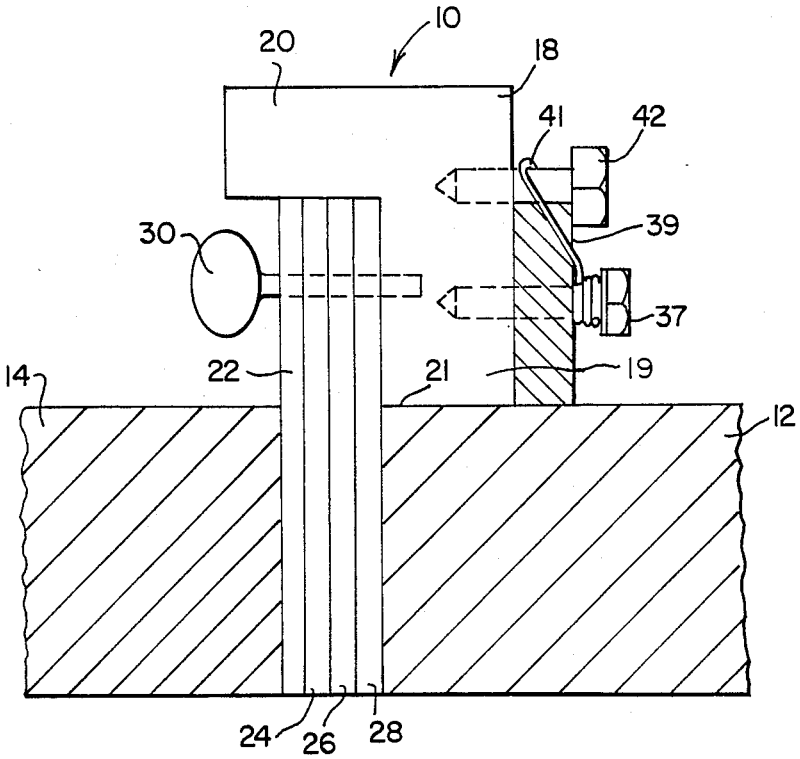
FIG. 2 is an end elevation, partially in section showing the downwardly extending wedge plates fitted between adjacent boards.
Figure 3:
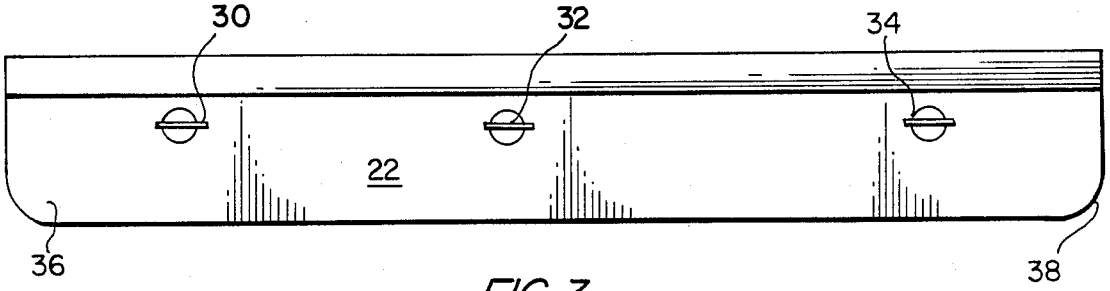
FIG. 3 is a rear elevation of the tool.

As illustrated in FIG. 2, the angle brace bottom 21 abuts the top of plank 12, such that downwardly extending inner wedge plate 28 and the desired spacer plates 24, 26 may extend between adjacent planks. An outer backing plate 22 may be employed with inner wedge plate 28 such that removable spacer plates 24, 26 may be secured by means of a plurality of wing bolts 30, 32, 34 extending through the plates and into vertical portion 19. Rounded edges 36, 38 of backing plate 22, wedge plate 28 and spacer plates 24, 26 facilitate insertion and removal of the tool from between planks. Manifestly, the number of removable spacer plates may be varied, according to the desired spacing between planks.

Figure 4:
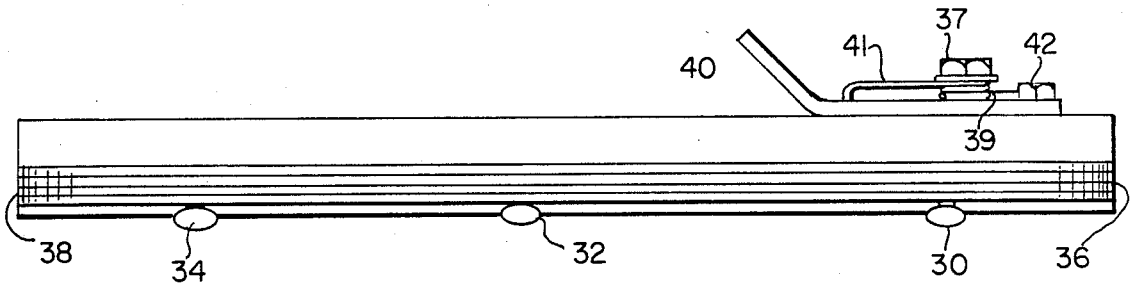
FIG. 4 is a bottom plan of the tool.
Figure 5:
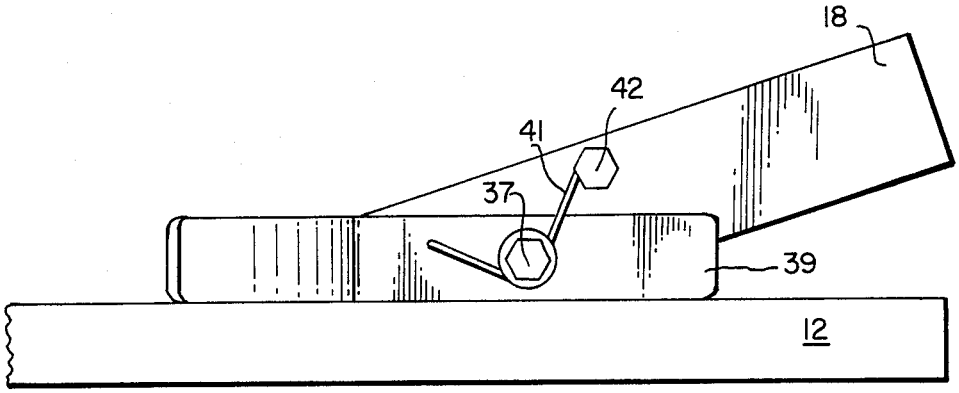
FIG. 5 is an enlarged, fragmentary end elevation, showing the removal lever pivotting downwardly in the attitude which enables removal of the tool from the spacing between adjacent boards.

As illustrated in FIGS. 2, 4, and 5 removal lever 39 may be pivoted upon bolt 37 which extends laterally through lever 39 and into the vertical portion 19 of the angle brace. The bottom of the removal lever 39 is in parallel alignment with bottom 21 of the angle brace, so as to abut the top of plank 12.

A torsion spring 41 may interconnect removal lever 39 being fitted in a hole therein, extend around shank bolt 37 at one end and be secured in a limiting pin 42 at its other end. As shown in FIG. 2, limiting pin 42 serves to align the removal lever in parallel with bottom edge 21 of the angle brace.

As it is desired to remove the decking spacer from between planks after they have been secured to a joist or the like, removal lever 39 may be pivoted downwardly as shown in FIGS. 5. Downward pivoting of removal lever 39 against plank 12 thus urges the angle brace 18 and wedge plate 28 outwardly and above the spacing. As the decking spacer is removed, torsion spring 41 urges removal lever 39 back to its position in parallel with angle brace bottom edge 21.

Thus, the tool overcomes two problems associated with the laying of decking. Conventionally, the desired spacing between boards or planks is required to be painstakingly measured and marked. Alternatively, a conventional wedge may be employed but, after nailing of the planks to a joist, it is exceptionally difficult to remove the wedge from between adjacent planks. The present tool thus serves the dual purpose of adjustably indexing the desired spacing between planks and facilitating removal of the wedge after nailing of the planks.

Manifestly, various configurations of wedge plates and removal levers may be employed without departing from the spirit and scope of invention, as defined in the claims.

I claim:

1. A decking spacer tool adapted for measured fitting between parallel boards prior to securing of the boards to a support, such as a joist, comprising:

(a) a longitudinally extending angle brace, further including:
  (i) a vertical portion adapted for support upon the top of a board being fitted; and
  (ii) a top horizontal portion extending laterally away from said vertical portion over the desired spacing area between adjacent boards;

(b) at least one wedge plate supported adjacent said angle brace and beneath said top portion as an index of the desired spacing between boards, said wedge plate extending vertically downwardly below said top portion and said angle brace, so as to fit between adjacent boards being secured; and (c) a removal lever pivoted upon a horizontal axis extending through said vertical portion, such that the lower surface of said lever may be aligned with the lower surface of said angle brace and in abutment with the top of a board being fitted, said lever being pivotable downwardly against the board, so as to urge said decking spacer upwardy and out of the space between boards being fitted.

2. A decking spacer as in claim 1, including torsion spring means interconnecting said removal lever and said vertical portion of said angle brace, so as to urge in pivoting return of said lever to alignment with the lower surface of said angle brace.

3. A decking spacer as in claim 2, including at least one vertically extending spacer plate fitted adjacent said wedge plate in the angle between the top portion and the vertical portion as an adjustable spacing index.

4. A decking spacer as in claim 3, further including a backing plate supported in said angle brace beneath said top portion and in spaced relationship with said vertical portion, such that said at least one spacer plate may be removably fitted between said backing plate and said vertical portion, according to the desired spacing between boards.

5. A decking spacer as in claim 4, said spacer plate, said wedge plate and said backing plate being rounded at their ends so as to assist in fitting within the space between adjacent boards.

6. A decking spacer as in claim 1, said removal lever including a gripping end extending outwardly away from said vertical portion, such that said removal lever may be manually grasped.

7. A decking spacer as in claim 5, said backing plate being secured to said vertical portion in spaced relationship by a series of wing bolts extending through said backing plate, said spacer plate and said wedge plate and into said vertical portion.

8. A decking spacer as in claim 6, said removal lever including a pivot pin extending through said lever and into said vertical portion.

9. A decking spacer as in claim 8, further including a limiting stud extending outwardly of said vertical portion above said removal lever and said pivot pin.

10. A decking spacer as in claim 9, further including a torsion spring interconnecting said removal lever, said pivot pin and said limiting stud.

* * * * *